US010519945B2

(12) United States Patent
Merlen et al.

(10) Patent No.: US 10,519,945 B2
(45) Date of Patent: Dec. 31, 2019

(54) METHOD FOR GENERATING A FLOW OF FLUID

(71) Applicants: UNIVERSITE SCIENCES TECHNOLOGIES LILLE, Villeneuve d'Ascq (FR); CENTRE NATIONAL DE LA RECHERCHE SCIENTIFIQUE—CNRS, Paris (FR); ECOLE CENTRALE DE LILLE, Villeneuve d'Ascq (FR)

(72) Inventors: Alain Merlen, Lille (FR); Farzam Zoueshtiagh, Lille (FR); Abdelkrim Talbi, La Madeleine (FR); Philippe Pernod, Lille (FR); Christophe Frankiewicz, Lille (FR)

(73) Assignees: UNIVERSITÉ DE LILLE, Lille (FR); CENTRE NATIONAL DE LA RECHERCHE SCIENTIFIQUE-CNRS, Paris (FR); ECOLE CENTRALE DE LILLE, Villeneuve d'Ascq (FR)

( * ) Notice: Subject to any disclaimer, the term of this patent is extended or adjusted under 35 U.S.C. 154(b) by 529 days.

(21) Appl. No.: 15/031,397

(22) PCT Filed: Oct. 24, 2014

(86) PCT No.: PCT/FR2014/052712

§ 371 (c)(1),
(2) Date: Apr. 22, 2016

(87) PCT Pub. No.: WO2015/059426

PCT Pub. Date: Apr. 30, 2015

(65) Prior Publication Data

US 2016/0258430 A1 Sep. 8, 2016

(30) Foreign Application Priority Data

Oct. 24, 2013 (FR) ..... 13 60387

(51) Int. Cl.
*F04B 43/04* (2006.01)
*F04B 19/00* (2006.01)
(Continued)

(52) U.S. Cl.
CPC ..... *F04B 43/046* (2013.01); *F04B 19/006* (2013.01); *F04B 43/028* (2013.01);
(Continued)

(58) Field of Classification Search
CPC ..... F04B 43/04; F04B 43/046; F04B 43/043; F04B 43/028; F04B 43/00; F04B 43/02;
(Continued)

(56) References Cited

U.S. PATENT DOCUMENTS 5,718,567 A 2/1998 Rapp et al.
5,938,117 A * 8/1999 Ivri ..... A61M 11/005 239/102.2

(Continued)

FOREIGN PATENT DOCUMENTS

DE 10 2008 004147 A1 7/2009
EP 2 306 019 A1 4/2011
WO 02/097270 12/2002

OTHER PUBLICATIONS

International Search Report, dated Mar. 3, 2015, from corresponding PCT application.

*Primary Examiner* — Philip E Stimpert
(74) *Attorney, Agent, or Firm* — Young & Thompson

(57) ABSTRACT

A method for generating a flow of fluid, implemented in a device including a membrane (2) provided with at least one hole (20) and elements (4) generating back-and-forth movements, wherein a flow is generated through the membrane by actuating the membrane, at least in the region of the at least one hole (20), according to a mode of deformation of the at least one hole, causing the at least one hole to open and close
(Continued)

and disturbing the fluid in order to generate the flow. The device suitable for implementing the method is also described.

18 Claims, 4 Drawing Sheets

(51) Int. Cl.
*F04B 43/02* (2006.01)
*F04B 53/10* (2006.01)
*F04B 45/047* (2006.01)
*F04F 7/00* (2006.01)

(52) U.S. Cl.
CPC ..... *F04B 43/043* (2013.01); *F04B 45/047* (2013.01); *F04B 53/10* (2013.01); *F04B 53/1077* (2013.01); *F04F 7/00* (2013.01)

(58) Field of Classification Search
CPC .... F04B 17/003; F04B 19/006; F04B 45/047; F04B 45/045; F04B 53/1077; F04B 43/0027
See application file for complete search history.

(56) References Cited

U.S. PATENT DOCUMENTS 8,678,787 B2 * 3/2014 Hirata ..... F04B 43/046 417/395
2006/0232167 A1 10/2006 Jordan
2009/0232685 A1 * 9/2009 Kamitani ..... F04B 43/046 417/413.2

* cited by examiner

FIG. 6
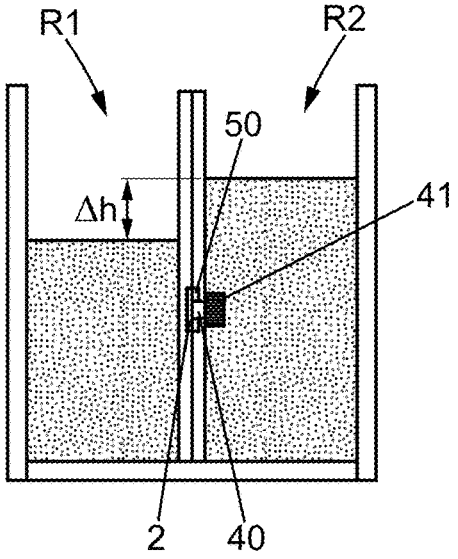
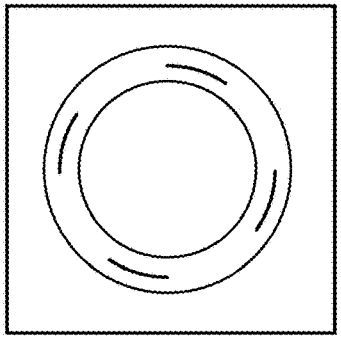
FIG. 7a
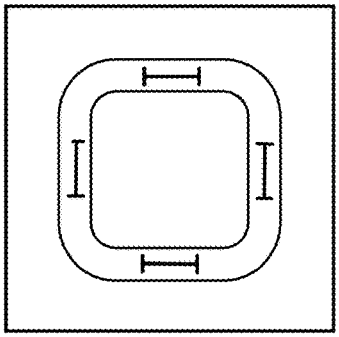
FIG. 8a
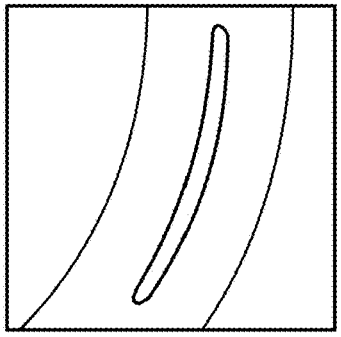
FIG. 7b
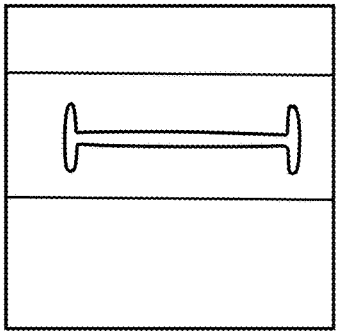
FIG. 8b
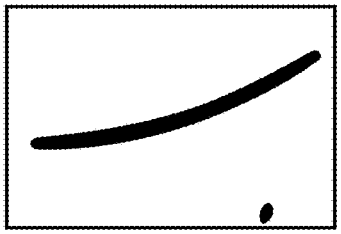
FIG. 7c
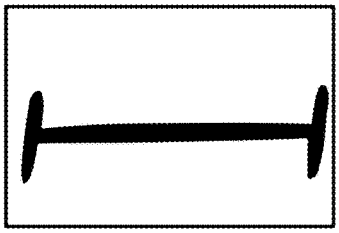
FIG. 8c

METHOD FOR GENERATING A FLOW OF FLUID

This invention has for object a method for generating a flow, as well as a device for generating a flow suitable for the implementation of the method.

The field of the invention relates to the field of devices for controlling and/or generating a flow of fluid, and more particularly micro-pumps or micro-mixers.

The invention shall have a particular application as micro-Tas for Lab-on-a-Chip applications.

It is known to use mechanical micro-pumps that use mobile parts, such as an oscillating membrane, a turbine or a piston, exerting a mechanical action directly on the fluid in motion.

Conventionally in particular in a device with a membrane, the design of these pumps involves the presence of a pumping chamber that compresses and/or expands the fluid circulating between the inlet and the outlet.

Such a device for generating flows is known for example in document U.S. Pat. No. 5,718,567 which describes a micro-pump with membrane comprising a pumping chamber connected to a suction channel and to a discharge channel, an intake valve on one end of the membrane, and an outlet valve on the other end of the membrane, a mechanism for driving the membrane, with the membrane comprising a deformable wall of the pumping chamber.

Such a micro-pump requires the presence of said pumping chamber and of valves in order to obtain the compression and the expansion of the fluid, which involves a device that is relatively cumbersome and generally complex to integrate.

When the pumping chamber is under negative pressure under the action of the membrane, the intake valve is open and the outlet valve is closed, causing the intake of the fluid from the feed channel to the pumping chamber. When the pumping chamber is in overpressure, under the action of the membrane, the intake valve is closed and the outlet valve is open, causing the discharge of the fluid to the discharge channel.

Generating the flow involves two crossings of the membrane, a first crossing from the feed channel to the pumping chamber by the intermediary of the intake valve and a second crossing from the pumping chamber to the discharge channel by the intermediary of the outlet valve.

Another disadvantage of such a micro-pump is that it can generate the flow only in a single direction, with the valves preventing the operation of the pump in the opposite direction.

Also, the design of such a micro-pump is complex and its manufacturing costs are high.

It is also known from document WO 02/097270 A1 a micro-pump, that comprises:

- a perforated element such as a perforated membrane, arranged between an inlet and an outlet of fluid for the pump, having one or several perforations (marked 14),
- at least one shutter system, adjacent to said perforated element on one of its sides, having at least one shutter facing at least one of the perforations and in such a way as to close said perforation when it is not used and,
- means for actuating in order to displace said perforated element alternatively in the directions to the outlet and the inlet of the pump.

In this anteriority, the flow of fluid from the inlet to the outlet is obtained, by actuating in phase opposition the perforated element and the shutter.

It is also known from document DE 10 2008 004147 a micro-pump comprising a membrane extending above a channel of fluid (10), with the membrane comprising a component of fluid (marked 4) having a passage through the membrane.

According to this document, the mechanics of the component of fluid marked 4 is such that the resistance to the flow through the passage according to a deflection of the membrane according to a first direction is greater than the resistance to the flow of the passage according to a deflection of the membrane according to a second direction and in such a way as to generate a net flow rate of fluid according to said first direction when the membrane is actuated according to a back-and-forth movement.

In this anteriority, the "component of fluid" is the essential element that makes it possible to generate the flow in a given direction: such a pump only has a single direction of operation, namely said first direction, and therefore cannot be bidirectional.

According to the example of FIG. 1, the component of fluid is a through-hole with tapered shape, such as a diffuser. This tapered portion is oriented in such a way as to have a preferred direction of flow (i.e. the direction of least resistance to the flow) through the membrane, according to said first direction.

According to other examples shown, in particular in FIG. 3*a*, the component of fluid comprises holes marked 4*a* in the membrane, as well as a valve with membrane marked 4*b*, able to close or open the holes by imposing a net flow rate, according to the first direction. According to this example, it is not the geometry of the hole that creates the preferred direction of flow, but the adding of an additional component (the valve with membrane, marked 4*b*).

Document US 2006/232167 A1 relates to a piezoelectric diaphragm having a membrane comprising an opening, marked 25.

This opening is provided with a flap valve arranged to close or open the opening in response to the movements of the diaphragm.

In this anteriority, the flow of the fluid through the membrane is obtained thanks to the valve that authorises a circulation of fluid in a single direction, from the feed chamber, marked 61 to the outlet chamber marked 65.

This valve can be an accessory inserted into the opening. Alternatively, the accessory can be a ball valve, or a precision orifice accessory.

In this anteriority, each accessory is a rigid element having a non-deformable orifice.

All the micro-pump devices of the anteriorities of documents WO 02/097270 A1, DE 10 2008 004147 or US2006/232167 each use a membrane actuated by a back-and-forth movement and making it possible to generate a flow, according to a net flow rate, at least in a first direction through the membrane.

In these devices, a regulating device is always required and associated with the membrane in order to impose a direction of circulation to the fluid, namely:

- The shutter system for the hole in document WO 02/097270 A1,
- the component of fluid, marked 4, imposing a least resistance to the flow of the fluid according to a preferred direction of flow, in document DE 102008004147,
- the flap valve, the accessory (ball valve) or the precision accessory in document US 2006/232167.

It is also known from document EP 2 306 019 A1 a micro fan, that comprises (see claim 1):

a first wall marked 30, the chamber of the fan being formed between the actuator, marked 50 and the first wall marked 30, a first opening 31 through the first wall 30, with the inside of the chamber of the fan being in communication with the outside of the chamber through the first opening 31, a second wall marked 10, on the side opposite the chamber of the fan, the first wall 30 being arranged between the second wall 10 and the chamber of the fan, the second wall 10 being at a distance of the first wall 30, a second opening 11 (outlet of the fan) through the second wall 10; a central space 21 formed between the first and the second wall, in communication with the first opening 31 and the second opening 11; and a feed passage 22 of which the outside end is in communication with the outside of the fan, and an inside end connected to the central space 21, a bottleneck 23 having a passage that is smaller than the feed passage 22.

Such a device according to this anteriority is suitable only for a compressible fluid and is not suited for generating a flow using an incompressible fluid, such as for example water.

According to this anteriority (paragraphs 36 and 37), the vibrations of the actuator marked 50 cause the vibration of the first wall marked 30 and generates in turn a fluctuation in the pressure in the chamber of the central space marked 21. Because of the bottleneck 23, this fluctuation is substantially dissipated through the second opening marked 11. As the flow of fluid in the central space is substantial, the internal pressure in the central space marked 21 is less than the pressure of the feed passage marked 22, which generates a pressure gradient creating a flow of fluid from the feed passage 22 to the central space 21.

This is a device with an extremely complex and expensive structure.

The invention has in particular for objective to overcome the various disadvantages of these known techniques.

More precisely, an objective of the invention is to provide a device that allows for easier integration and that makes the devices more compact, and according to the desire of the inventor, not requiring a pumping chamber and valves in order to operate, even generally, any other flow rate regulating device, and in particular those taught in the aforementioned anteriorities.

Another objective of the invention is, at least in one particular embodiment, to propose a device of simple design and which by the same occasion reduces the manufacturing costs.

Another objective of the invention is, at least in one particular embodiment, to propose a device that makes it possible to obtain better performance.

Another objective of the invention, is at least in one embodiment to propose a method for generating a flow of fluid.

These objectives, as well as others which shall appear more clearly in what follows, are achieved according to the invention using a method for generating a flow of fluid implemented in a device comprising a membrane provided with at least one hole as well as means generating back-and-forth movements, wherein a flow is generated through the membrane by actuating said membrane, at least on said at least one hole, according to a mode of deformation of said at least one hole causing said at least one hole to open and close and disturbing the fluid in order to generate said flow through the membrane, in a given direction (i.e. to suction or to discharge).

The method implemented makes it possible to generate a flow par a single crossing of the fluid through the membrane, advantageously without requiring a pumping chamber to compress or expand the fluid, or any valve and such as encountered in prior art known through document U.S. Pat. No. 5,718,567.

According to current understanding, the controlled deformation of the membrane, at least on said at least one hole allows for the implementation of a mode of deformation of said at least one hole which generates a flow of fluid.

According to the invention, it is the mode of deformation of the hole resulting from the actuating of the membrane that causes the flow of the fluid, and as such the generating of a net flow rate through the membrane in a given direction, to "discharge" or to "suction": this hole is not associated with any added flow-regulating device such as a valve (or other element shutting off the hole in order to impose a direction of flow), nor does it have a geometry that is proper or an accessory imposing a preferred direction of circulation of fluid through the membrane.

Also a first advantage of the method according to the invention is that it requires, for its implementation, only a device with an extremely simple structure, comprising solely for essential elements, on the one hand, the membrane provided with said at least one hole (deformable), and on the other hand, means generating back-and-forth movement associated with this membrane.

According to optional characteristics of the invention, taken individually or in combination:

the back-and-forth movements are periodic movements or;

the back-and-forth movements are pseudoperiodic movements or aperiodic movements;

said mode of deformation of said hole can include movements of bending of the membrane and/or movements of torsion and/or of compression and/or of tension of the membrane or a combination of these movements;

the membrane is able, during its back-and-forth movements, to circulate a fluid through said at least one hole and able to prohibit the circulation of the fluid when it is at rest;

alternatively, said membrane generates leaks at rest, through said at least one hole, leaks that can be stopped when the membrane is actuated;

said at least one hole authorising a circulation of fluid through the membrane, in a first direction, from one side to the other of the membrane, and in a second opposite direction, and wherein the direction of circulation of the fluid through the membrane is changed by the controlling of the excitation of the means generating back-and-forth movements allowing for an operation as discharge (resp. as suction) in a given direction of circulation, then after a change in the excitation on the means generating back-and-forth movements, as suction (resp. as discharge) in an opposite direction of circulation;

the direction of circulation of the fluid is changed by modifying the mode of deformation of the membrane, said means generating back-and-forth movements comprise an electromagnetic actuator, a piezoelectric actuator or an electrostatic actuator, said means generating back-and-forth movement are separate from the membrane and cooperate with said membrane to actuate and deform the membrane at least on said at least one hole.

the means generating back-and-forth movements comprise said membrane which is per se an actuator, with said membrane comprising at least partially an electro-active polymer.

said at least one hole is of submillimetric or millimetric dimension;

the pattern of said at least one hole is chosen from a pattern as an H, a U, a sinusoid, in particular as a W, an I, in vertical lines or as parallel lines.

The invention also relates to a device for generating a flow of fluid, suitable for the implementation of the method, and comprising:

a first fixed portion, made of rigid material, having a through-recess;

a second portion, comprising a membrane, connected to said first portion on its periphery and covering the recess;

means generating back-and-forth movements able to deform the membrane;

at least one hole on the mobile portion of the membrane, able, during movements of the membrane to circulate a fluid through the membrane, and possibly able to prohibit the circulation of the fluid when the mobile portion is at rest, in such a way as to allow for the generating of a flow through the membrane by exciting the membrane in such a way as to actuate and deform said at least one hole according to a mode of deformation of said at least one hole and generating a flow through the membrane in a given direction.

According to characteristics of the invention, taken individually or in combination:

the device comprises a third portion made of rigid material, connected to one of the faces of the membrane, said third portion being arranged on the recess and of dimensions less than those of the recess in such a way as to form an inter-space between said first portion and said third portion and in such a way as to form a mobile portion comprising the mobile portion of the membrane and said third portion, said means generating back-and-forth movements cooperating with the third rigid portion, said at least one hole being located on said inter-space, said at least one hole is of submillimetric or millimetric dimension;

the hole selectively comprises, a pattern in the shape of an H, a U, an I, a sinusoid (a W), or said at least one hole comprises several close parallel holes;

said at least one hole authorises a circulation of fluid through the membrane, in a first direction, from one side to the other of the membrane, and in a second opposite direction;

the device comprises means for controlling said means generating back-and-forth movements in such a way as to make it possible to change the direction of circulation of the fluid through the membrane;

said means of back-and-forth movement include an electromagnetic actuator such as a magnet couple/coil, a piezoelectric actuator, an electrostatic actuator, a magnetostrictive actuator, a ferro-electric actuator, a thermal actuator, or a shape memory actuator.

Other characteristics and advantages of the invention shall appear more clearly when reading the following description of a particular embodiment of the invention, provided solely as a non-limiting example for the purposes of information, and the annexed drawings, among which:

FIG. 1 is a cross-section view of the device for the generating of a flow according to the invention;

FIGS. 2*a* to 2*c* are top views of the device according to different embodiments of the invention;

FIGS. 3*a* to 3*d* are diagrammatical views of different embodiments of the holes according to the invention;

FIG. 6 is a diagrammatical view of a test bench of a device according to the invention, FIGS. 7*a*, 7*b*, 7*c* are photos of details of a shape of hole possible in the membrane, namely a curved slot, FIGS. 8*a*, 8*b*, 8*c* are photos of details of another possible shape as "H".

Figure 1:
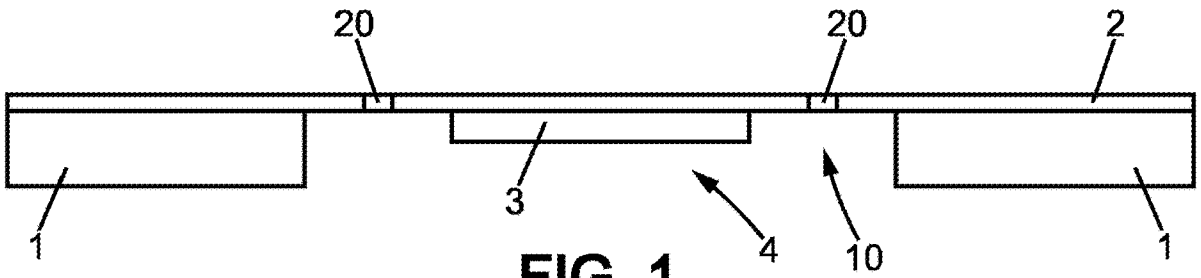

As mentioned hereinabove, the general principle of the invention is therefore based on the implementation of a method for generating a flow of fluid implemented in a device comprising a membrane 2 provided with at least one hole 20 as well as means 4 for generating back-and-forth movements.

According to the invention, a flow is generated through the membrane by actuating said membrane, at least on said at least one hole, according to a mode of deformation of said at least one hole causing the openings and closings of said at least one hole and disturbing the fluid in order to generate said flow.

The method implemented makes it possible to generate a flow by a single crossing of the fluid through the membrane, not two as in document U.S. Pat. No. 5,718,567.

Advantageously, the method according to the invention does not require a pumping chamber, or valves, to compress or expand the fluid and such as encountered in prior art known through document U.S. Pat. No. 5,718,567.

According to the invention, it is the mode of deformation of the hole resulting from the actuating of the membrane that causes the flow of the fluid, and as such the generating of a net flow rate through the membrane in a given direction, "as discharge" or as "suction": this hole is not associated with any added flow-regulating device such as a valve (or other element shutting off the hole in order to impose a direction of flow), nor does it have any proper geometry or an accessory imposing a preferred direction of circulation of fluid through the membrane.

Surprisingly, the inventors have as such observed, that such a simply perforated membrane (i.e. without a flow-regulating device such as a valve or other shutter, or even having a geometry of the hole imposing a preferred direction of flow) made it possible, when deformed according to a mode of deformation of the hole, to generate a circulation of fluid, in a single direction (as "discharge" or as "suction"). Such an observation therefore goes against the prejudice taught by prior art (in particular WO 02/097270 A1, DE 102008 004147 or US2006/232167) according to which a flow-regulating device (valve or other shutter), or a specific geometry of the hole ("of section as a diffuser" according to document DE 10 2008 004147) is required to generate a flow through the membrane according to a given direction.

Furthermore, the inventors have observed that it was possible to change the direction of circulation of the fluid (from the "suction" direction to the "discharge" direction or inversely) by changing the excitation on the means generating back-and-forth movements, and even the mode of deformation of the hole, in particular in that said at least one hole in the membrane does not have any preferred direction of flow, and is devoid of a flow-regulating device.

Also a first advantage of the method according to the invention is that it requires, for its implementation, only a device with an extremely simple structure, comprising solely for essential elements, on the one hand, the membrane provided with said at least one hole (deformable), and on the other hand, means generating back-and-forth movement associated with this membrane. Furthermore and if the hole can have different possible shapes, the latter is not configured to impose a preferred direction of flow through the membrane.

According to an embodiment the back-and-forth movements are periodic movements, such as for example movements of oscillations. It is also possible to generate a flow of fluid thanks to pseudoperiodic movements or aperiodic movements.

According to an embodiment, back-and-forth movements of the membrane 2 are generated which create movements of bending of the membrane 2. Alternatively, movements of the membrane are generated that create torsion movements of the membrane, or movements of tension and/or movements of compression of the membrane. The movements generated can again be a combination of all or of any of these different movements. The mode of deformation (bending and/or torsion and/or compression and/or tension) makes it possible, in combination with the openings and closings of said at least one hole, to generate the flow of fluid through the membrane 4.

Said at least one hole 20 authorises a circulation of fluid through the membrane, in a first direction, from one side to the other of the membrane, and in a second opposite direction. To this effect, this hole is not associated with any flow-regulating device such as a valve, valves, or other shutting-off system, nor does it have a geometry that is proper that creates a least resistance of flow in a given direction, and as such a preferred direction of flow through the membrane.

Advantageously, it is perhaps possible to change the direction of circulation of the fluid through the membrane by the controlling of the excitation of the means generating back-and-forth movements. The direction of the circulation of the fluid can for example be changed by modifying the mode of deformation of said membrane 2. For example, as a non-limiting example, the direction of circulation of the fluid can be changed by varying the oscillation frequency of the membrane 2. It is also possible to change the direction of circulation by applying a voltage offset, with a positive or negative sign. It is as such possible to operate the micro-pump as discharge (resp. as suction), with the circulation of the fluid passing through the membrane according to a first direction, then by modifying the excitation of the means generating back-and-forth movements, even the mode of deformation of the hole, to operate the micro-pump as suction (resp. as discharge), with the circulation of fluid passing through the membrane according to a second direction (opposite the first direction).

According to an embodiment, the means for generating 4 back-and-forth movements include electro-active or magneto-active means, such as for example an electrostatic actuator, an electromagnetic or piezoelectric actuator. The means 4 for generating back-and-forth movements are excited by a variable current signal. Possibly an offset is applied on the voltage positively or negatively, in such a way as to generate the flow.

Figure 3A:
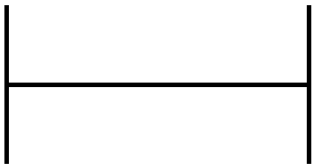
Figure 3C:
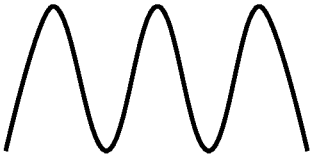
Figure 3B:
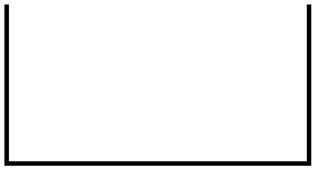

In a particular case, the hole or holes are of a submillimetric or millimetric dimension. Said hole 20 can be a slot. The width of the slot can be between 1 micron and 500 microns. The length of said slot can be between 1 micron and 2,000 microns. In the entire application the dimensions of the hole are those of holes when the membrane is not subjected to a constraint. Among all of the patterns possible, the pattern of said at least one hole 20 can be chosen from a pattern as H (FIG. 3*a*), as U (FIG. 3*b*), as a sinusoid (i.e. W) (FIG. 3*c*). The shapes as H and as U make it possible to provide a maximum opening, while the opening in the form of a sinusoid makes it possible to obtain a maximum length. The hole can again be simply of circular shape.

Figure 3D:
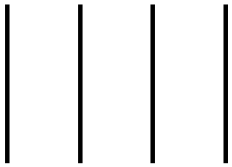
Figure 4:
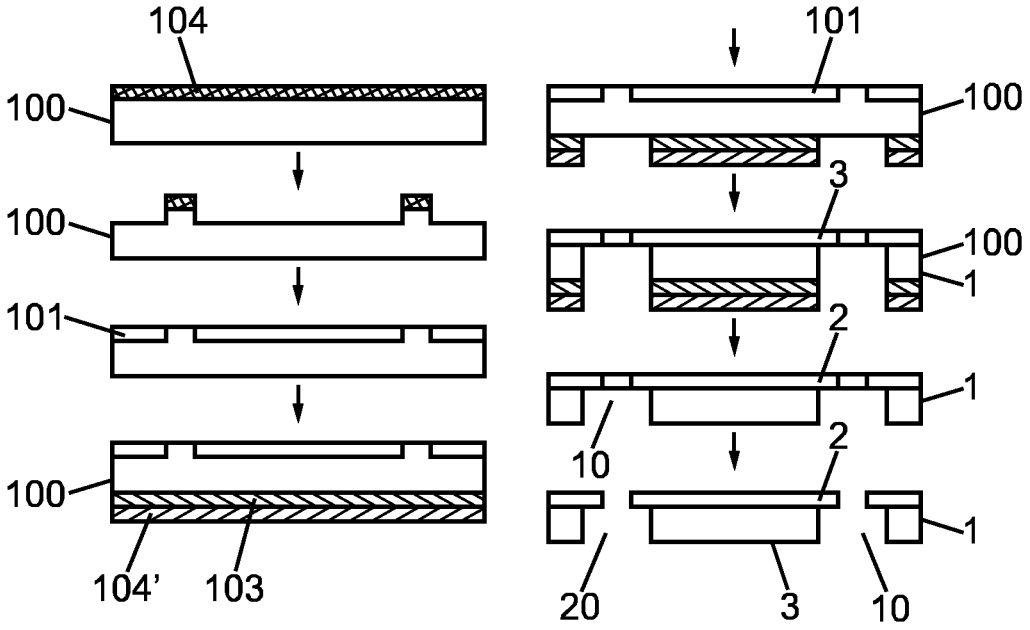
FIG. 4 shows the different steps in the method of manufacturing a device according to the invention.

According to an embodiment shown in FIG. 3*d*, said at least one hole 20 comprises several holes forming close parallel lines (FIG. 3*d*). Two neighbouring lines are brought closer by a dimension less than the length of the holes. Such patterns make it possible to obtain a more rigid opening 20 and therefore to limit leaks during a stoppage of the device.

According to an embodiment, the means generating back-and-forth movements are separate from the membrane and cooperate with said membrane to actuate and deform the membrane at least on said hole. Alternatively, the membrane can be active, comprising an ionic polymer excited by electrodes. Again, the membrane can be active, comprising a flexible material loaded with magnetic nano-materials (for example Fe, FexOy, permanent magnet, etc.) or dielectric (for example LiNBO3, SiO2, etc.), or metal (for example carbon nanotube, graphene, etc.). The introduction of these materials makes it possible to render said membrane active intrinsically and can be used for example as an active flexible piezoelectric, or dielectric, or ionic, or magnetic material.

More precisely, such a device intended for the implementing of the method according to the invention can comprise:

- a first fixed portion 1, made of rigid material such as silicon for example, having a recess passing through its entire height;
- a second portion, comprising a membrane 2 in particular made of flexible elastomer, of the PolyDiMethylSiloxane (PDMS) or Silastic S type for example, connected to the first portion 1, in particular in a manner sealed to the fluid, on its periphery and covering the recess 10. Note that any flexible elastomer known to those skilled in the art can be suitable for the carrying out of the membrane 2;
- means for generating 4 movements able to deform the mobile portion of the membrane 2;
- at least one hole 20 of the membrane on the mobile portion of the membrane, able, during back-and-forth movements of the membrane to circulate a fluid through the membrane 2, and, preferably, able to prohibit the circulation of the fluid when the mobile portion 31 is at rest.

Such a device allows for the generating of a flow through the membrane by deforming the membrane 2 in such a way as to actuate said at least one hole 20 according to a mode of deformation, in order to cause openings of said at least one hole 20 during movements.

According to an embodiment, the device comprises a third portion 3 made of rigid material, such as silicon for example, connected to one of the faces of the mobile portion of the membrane 2, said third portion 3 being arranged at the centre of the recess 10.

The third portion is of a dimension less than that of the recess 10 in such a way as to form an inter-space 30 between said first portion and said third portion 3, and in such a way as to form a mobile portion comprising the mobile portion of the membrane 2 and the third portion 3 in a particular configuration at the centre of the recess 10.

The means 4 for generating movements are able to cooperate with said third portion 3 in such a way as to actuate the mobile portion as well as the hole or the mobile portion as well as the hole or holes 20 of the membrane 2 on the inter-space.

The mode of operation of the device can be dual, i.e. the membrane 2 is able, during back-and-forth movements of the mobile portion 31, to circulate a fluid in both directions, with the device making it possible to carry out a suction as well as a discharge of the fluid. A modification of the device is not required here in order to modify the direction of circulation of the fluid. A bidirectional mode of operation can also be spoken of To this effect, said at least one hole 20 must authorise a circulation of fluid through the membrane, in a first direction, from one side to the other of the membrane, and in a second opposite direction.

Moreover, the device is able to circulate a fluid through the membrane 2 during movements of the mobile portion, and is able, more preferably, to prohibit the circulation of the fluid when the mobile portion is at rest.

Figure 2A:
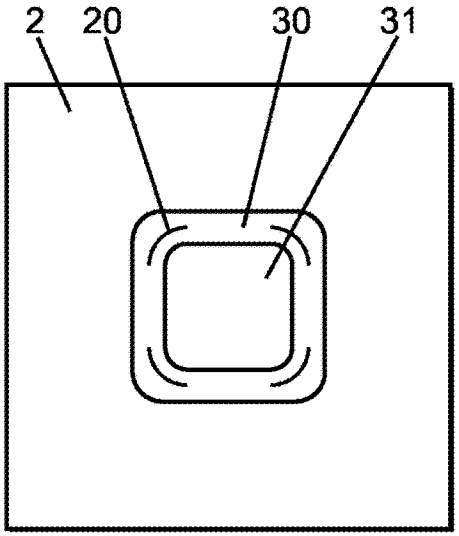
Figure 2B:
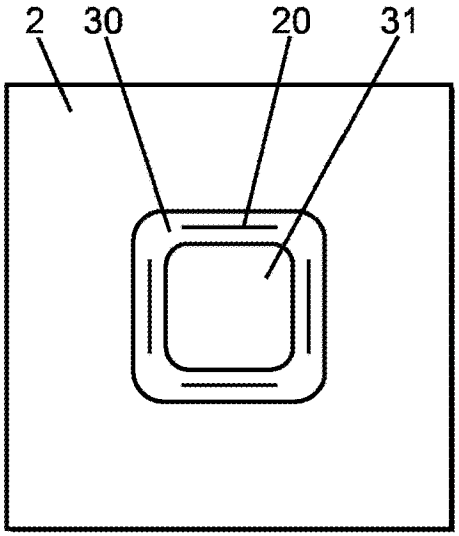
Figure 2C:
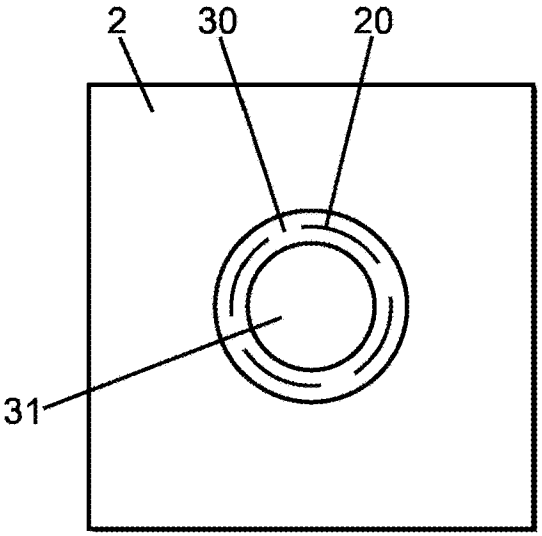

As can be seen in FIGS. 2*a* to 2*c*, by way of a non-limiting example, said at least one hole 20 can extend at mid-distance between the edge of the first portion 1 and the edge of the third portion 3.

According to another embodiment of the invention, said at least one hole 20 is arranged on corners of said third portion 3. Of course, the position of the hole or holes 20 can be modified according to need.

The structure of the device is defined by the length and the width of the fixed portion 1, which can, by way of a non-limiting example, vary between 2 mm and 20 mm, as well as by the length and the width of the flexible membrane 2, which can vary between 2 mm and 20 mm also.

The structure of the device is also defined by the length and the width of the third portion 3, which can vary between 500 μm and 10 000 μm, and by the length and the width of the recess 10, which can vary between 500 μm and 10,000 μm.

The thickness of the fixed portion 1, varies between 100 μm and 10,000 μm, that of the membrane 10 made of flexible elastomer, varies between 10 μm and 200 μm, and that of the third portion 3, varies between 0 and 10,000 μm.

According to an embodiment of the invention, the width of said at least one hole 20 is between 1 μm and 500 μm and the length of said at least one hole is between 1 μm and 2000 μm, As such, the choice of the width of the recess 10, of the third portion 3, as well as of the thickness of the membrane 2 results from a compromise between the flexibility of the membrane 2 desired and its robustness during the actuating. A membrane 2 that is not very wide and thick will be more resistant but will not make it possible to obtain substantial displacement of the membrane 2. Inversely, a membrane 2 that is thin and wide will be flexible but not very resistant to the forces of traction and torsion applied to the membrane 2.

Moreover, the length and the width of said hole 20 are determining factors for the performance of the device, in particular for the flow rate and the pressures generated. For example, a hole 20 of substantial size, for example 500 μm wide and 2000 μm long, will make it possible to obtain high flow rates.

As can be observed in FIG. 1, the third portion 3 is advantageously arranged on the recess 10 of the fixed portion 1, and is arranged between the openings 20 of the membrane 2, as such forming the mobile portion 31. Such an arrangement makes it possible, during back-and-forth movements to deform the membrane 2 in particular on the hole or holes 20 in such a way as to circulate a fluid through the membrane 2.

Such as shown in FIG. 2*c*, the recess 10 of said first portion 1 can be circular, said third portion 3 adopting for example a circular shape in such a way as to form a circular inter-space 30.

In FIGS. 2*a* and 2*b* the recess of the first portion 1 is rectangular, the third portion 3 adopting a rectangular shape in such a way as to form a rectangular inter-space 30.

According to the preceding embodiment, the corners of the rectangular inter-space are rounded in order to limit the constraints implied by angular corners during the oscillation of the membrane 2. Indeed, by retaining a right angle, the membrane 2 is exposed to a risk of tearing on said corners.

According to a particular embodiment of the invention, the excitation signal of the membrane 2 is varied, via means for controlling acting on the means 4 for generating back-and-forth movements, in such a way as to change the direction of circulation of the fluid. For example, the direction of circulation of the fluid is changed by varying the excitation frequency of the membrane.

According to a first prototype, and according to the observations of the inventor, a suction/discharge change was measured, by way of a non-limiting example around 225-275 Hz. In this frequency range, the main vibration mode observed is a so-called torsion mode, with a so-called bending mode being observed at the other frequencies.

The inventor has also observed that the position of the hole or holes 20 influences the performance of the device. Indeed, when the holes 20 are arranged on corners, the torsion mode is predominant around 225-275 Hz, with the device then operating as discharge. Inversely, outside of this range of frequencies, the device operates as suction.

The position of the holes 20 on corners thus makes it possible to obtain better performance in torsion mode, with the openings 20 opening more substantially.

Likewise, the inventor observed that in the case of holes 20 arranged at mid-distance between the edge of the first portion 1 and the edge of the third portion 3, the performance in suction is better. Indeed, the bending mode allows for a greater clearance and a better opening of the holes 20 arranged at mid-distance between the edge of the first portion 1 and the edge of the third portion 3.

The inventor moreover observed two peaks of resonance located at around 100 Hz and 175/200 Hz, with the resonance peaks generating a more substantial deflection of the membrane 2 and therefore an increase in the flow rate. According to an embodiment, it is possible to excite the membrane 2 at its resonance frequency or frequencies.

It is understood that the frequencies and other parameters mentioned hereinabove and hereinbelow are mentioned by way of a non-limiting example, for a given prototype. These parameters (the frequencies for the change in regime and the resonance frequencies in particular) depend on the parameters of the device such as the material used for the membrane, the dimensions of the membrane (thickness in particular), the tension exerted on the membrane and the weight of the mobile portion in particular, and are specific to the device carried out.

According to another particular embodiment of the invention, the means for generating oscillations 4 include electromagnetic means that are excited by an alternating current signal and whereon an offset is applied on the voltage in such a way as to change the operation mode of the device, i.e. change the direction of circulation of the fluid.

For example, by way of a non-limiting example, an offset of 125 mV on a voltage of 500 mV peak-to-peak will offset the origin of the zeros in voltage to 125 mV. As such, the signal delivered to the electromagnetic means before amplification will oscillate between −125 mV and 375 mV. Such an offset has for effect to change the origin of the vibration of the membrane 2, of the mobile portion 31 more precisely.

According to the observations of the inventor and according to the prototype tested, a positive change in the offsets makes it possible to have the device operate as discharge, while a negative change in the offsets makes it possible to have the device operate as suction.

According to an embodiment of the invention, the means generating back-and-forth movements 4 include electromagnetic means such as a magnet couple 40 associated with a coil 41. The magnet 40 can be integral with the third portion, and the coil is integral with a separate support, for example in rigid connection with the first portion 1. Other means known to those skilled in the art can also be considered, such as piezoelectric or electrostatic means.

Figure 5:
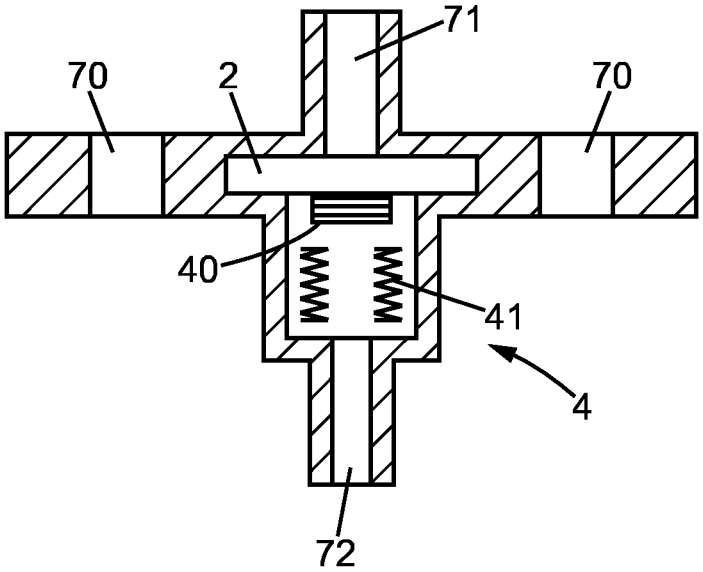
FIG. 5 is a diagrammatical cross-section view of a packaging of the device according to the invention.

As can be observed in FIG. 5, the device is set in place within a packaging 7 in the form of a case receiving the device, in such a way as to seal it. The packaging 7 respectively comprises a housing for the device as well as for the magnet, orifices 70 able to receive a screw/nut system or any other type of mechanical maintaining in order to maintain the packaging 7 on a support, as well as an inlet 71 and an outlet 72 for the passing of the fluid to be circulated. Such as shown in FIG. 5, the coil 41 is provided inside the path of the fluid between the inlet 71 and the outlet 72 of the device. Alternatively, it is of course understood that the coil 41 can be located outside so that it is not exposed to the fluid, which can be important for certain applications.

The invention also relates to a method for manufacturing a device, according to the invention, for the generating of a flow of fluid comprising the following steps:

- a layer of resin 104 is deposited via coating on the front face of a wafer of silicon 100;
- a photolithography and an anisotropic DRIE etching are carried out in order to define one or several protruding patterns on the wafer of silicon, with corresponding dimensions of said at least one hole 20, intended to create said at least one hole 20;
- a spin coating is carried out of the elastomer 101 of the membrane 2 according to the desired thickness;
- a layer of aluminium 103 then a layer of resin 104' are deposited on the rear face of the wafer of silicon;
- a photolithography and an anisotropic DRIE etching are carried out over the entire thickness of the wafer of silicon as such obtaining the first portion 1 and the third portion 3;
- the remainder of the resin and aluminium remaining on the wafer of silicon are chemically suppressed;
- an RIE plasma etching of the elastomer is carried out in order to release the holes 20;
- optionally, a layer of SiO2 is applied between the front face of the silicon wafer and the layer of elastomer in order to improve the adherence between the two portions.

Generally, the material used for the membrane can be an elastomer such as for example SILASTIC®, or HV 1540/20P® from Dow Corning.

A bench carried out for testing the device according to the invention is shown diagrammatically in FIG. 6. This bench forms two containers R1, R2, separated by a partition whereon is fixed the device according to the invention, through an opening of the partition. The seal between the device and the partition is provided by an O-ring 50. The means for generating movement are electromagnetic and include a magnet couple 40 and coil 41.

In such a system, the membrane 2 separates the respective volumes of the two containers R1, R2. According to the tests carried out, the volumes of the two containers R1, R2 are filled with a liquid (i.e. water), and in such a way that the device and its membrane 2 are fully immersed.

The generator of back-and-forth movements is controlled in such a way as to deform the hole of the membrane according to a mode of deformation of the hole, for example by exciting the magnet couple/coil at a given frequency (with or without voltage offset).

These tests made it possible to confirm the pertinence of the method, through the observation of a constant net flow rate through the membrane in a given direction, with this flow able to be monitored through the constant change in the difference of the level "h" of the liquid between the two containers R1, R2. During these tests, the hole (or each one of the holes) of the membrane is not associated with any added flow-regulating device such as a valve (or other element shutting off the hole in order to impose a direction of flow), nor does it have a geometry that is proper or an accessory imposing a preferred direction of circulation of fluid through the membrane.

Furthermore these tests have made it possible to demonstrate that this device operates as discharge or as suction, with the change in the direction of flow able to be obtained by changing the mode of deformation of the hole.

The net flow rates obtained during the tests were between 10 and 10,000 μL/min with water. However, higher flow rates can be considered, reasonable at least up to 900 mL/min by optimising the size and the number of openings in particular.

The simplicity and the very low cost of manufacturing the device implemented according to the invention can make it possible to design the perforated membrane and its support as a removable unit of the device, for single use.

After each use, this perforated membrane/support unit can be simply removed from the body of the device, and discarded. During a new use it is replaced with a new unused unit: this component of the device, disposable, does not need to be cleaned and/or sterilised before proceeding with another use of the device.

Naturally, other embodiments could have been considered by those skilled in the art without however leaving the scope of the invention defined by the claims hereinafter.

NOMENCLATURE

1. Fixed portion,
10. Recess of the fixed portion,
2. Membrane made of flexible elastomer,
20. Holes,
3. Third portion,
30. Inter-space,
31. Mobile portion,
4. Means for generating oscillations,
40. Magnet,
41. Coil,
50. O-ring,
7. Packaging,
70. Orifices,
71. Inlet,
72. Outlet.

100. Silicon,
101. Elastomer,
102. Nickel,
103. Aluminium,
104,104'. Resin.

The invention claimed is:

1. A method for generating a flow of a fluid implemented in a device, wherein the device consists essentially of:

a fixed first portion, made of rigid material, having a through-recess, a second portion, comprising a membrane provided with at least one hole that is deformable on a mobile portion of said membrane, the second portion being configured to, during movements of the membrane, circulate the fluid through the membrane, and means for generating back-and-forth movement, said means generating back-and-forth movement of the membrane, said membrane being connected to said first portion on a periphery of said membrane and covering the recess, the method comprising:

generating said flow through the membrane by actuating said membrane, at least on said at least one hole, according to a mode of deformation of said at least one hole causing openings and closings of said at least one hole, and disturbing the fluid in order to generate said flow through the membrane, in a direction of circulation, and wherein the flow of the fluid, and as such the generating of a net flow rate through the membrane in the direction of circulation, is caused solely by the mode of deformation of the at least one hole that results from the actuating of the membrane, the openings and closings of said at least one hole caused by the mode of deformation of the at least one hole disturbing the fluid and generating a mechanical work that generates the net flow, wherein the at least one hole is not associated with any added flow-regulating device, and wherein the at least one hole does not have any any proper geometry nor any accessory that limits the direction of circulation of fluid through the membrane.

2. The method according to claim 1, wherein the back-and-forth movements are periodic movements.

3. The method according to claim 1, wherein the back-and-forth movements are pseudoperiodic movements or encore aperiodic movements.

4. The method according to claim 1, wherein the mode of deformation of said at least one hole comprises bending movements of the membrane and/or torsion and/or compression and/or tension movements of the membrane or a combination of these movements.

5. The method according to claim 1, wherein the membrane, during its back-and-forth movements, circulates the fluid through said at least one hole and prohibits the circulation of the fluid when it is at rest.

6. The method according to claim 1, wherein the membrane generates leaks at rest.

7. The method according to claim 1, wherein:

said at least one hole allows circulation of fluid through the membrane, in a first direction and in a second direction opposite said first direction, and wherein the direction of circulation of the fluid through the membrane is changed by the controlling of the excitation of the means for generating back-and-forth movement, thereby allowing for an operation as discharge in the first direction, and, circulation, then after a change in the excitation of the means for generating back-and-forth movement, as suction in the second direction.

8. The method according to claim 7, wherein the direction of circulation of the fluid is changed by modifying the mode of deformation of the membrane.

9. The method according to claim 1, wherein the fluid is an incompressible fluid.

10. The method according to claim 1, wherein the fluid is a compressible fluid.

11. The method according to claim 1, wherein said means for generating back-and-forth movement include an electromagnetic actuator, a piezoelectric actuator, an electrostatic actuator, a magnetostrictive actuator, a ferro-electric actuator, a thermal actuator, or a shape memory actuator.

12. The method according to claim 1, wherein the means for generating back-and-forth movement are separate from the membrane and cooperate with said membrane in order to actuate and deform the membrane at least on said hole.

13. The method according to claim 1, wherein said at least one hole is of submillimetric or millimetric dimension.

14. The method according to claim 1, wherein said at least one hole selectively comprises a pattern in the shape of an H, a U, a W, an I, as a sinusoid, or said at least one hole comprises several parallel slots.

15. The method according to claim 1, wherein said means for generating back-and-forth movement include an electromagnetic actuator, a piezoelectric actuator, or an electrostatic actuator.

16. The method according to claim 1, wherein the perforated membrane and a support of the perforated membrane are designed as a removable unit of the device.

17. The method according to claim 1, wherein the membrane is an active membrane, and the means for generating back-and-forth movement is incorporated into the membrane.

18. A method for generating a flow of a fluid implemented in a device, wherein the device consists essentially of:

a first fixed portion, made of rigid material, having a through-recess, a second portion, comprising a membrane provided with at least one hole that is deformable on a mobile portion of said membrane, the second portion being configured to, during movements of the membrane, circulate the fluid through the membrane, wherein said at least one hole allows circulation of fluid through the membrane, in a first direction, from one side to the other of the membrane, and in a second direction opposite said first direction, means for generating back-and-forth movement, said means generating back-and-forth movement of the membrane, and means for controlling the means for generating back-and-forth movement in such a way as to make it possible to change the direction of circulation of the fluid through the membrane the method comprising:

generating said flow through the membrane by actuating said membrane, at least on said at least one hole, according to a mode of deformation of said at least one hole causing openings and closings of said at least one hole, and disturbing the fluid in order to generate said flow through the membrane in the direction of circulation, and wherein the flow of the fluid, and as such the generating of a net flow rate through the membrane in the direction of circulation, is caused solely by the mode of deformation of the at least one hole that results from the actuating of the membrane, the openings and closings of said at least one hole caused by the mode of deformation of the at least one hole disturbing the fluid and generating a mechanical work that generates the net flow, wherein the at least one hole is not associated with any added flow-regulating device, and wherein the at least one hole does not have any proper geometry nor any accessory that limits the direction of circulation of fluid through the membrane.

* * * * *